United States Patent [19]

Huebner et al.

[11] 4,336,132

[45] Jun. 22, 1982

[54] VALVE FOR A WET JIGGING MACHINE FOR SEPARATING MINERALS

[75] Inventors: Friedhelm Huebner; Karl-Heinz Weiffen, both of Bochum-Riemke, Fed. Rep. of Germany

[73] Assignee: Klöckner-Humboldt-Deutz AG, Fed. Rep. of Germany

[21] Appl. No.: 194,150

[22] Filed: Oct. 6, 1980

[30] Foreign Application Priority Data

Oct. 6, 1979 [DE] Fed. Rep. of Germany ..... 2940568

[51] Int. Cl.[3] ..... B03B 5/24

[52] U.S. Cl. ..... 209/500; 251/137

[58] Field of Search ..... 209/500, 455; 251/129, 251/137, 333

[56] References Cited

U.S. PATENT DOCUMENTS

| | | | |
|---|---|---|---|
| 3,051,196 | 8/1962 | Miller | 251/333 X |
| 3,108,777 | 10/1963 | Ray | 251/129 X |
| 3,394,732 | 7/1968 | Lisciani | 251/333 X |
| 3,424,426 | 1/1969 | Neff | 251/137 X |
| 4,019,981 | 4/1977 | Stern et al. | 209/500 X |
| 4,105,726 | 8/1978 | Lindberg | 251/137 X |

*Primary Examiner*—Ralph J. Hill

*Attorney, Agent, or Firm*—Hill, Van Santen, Steadman, Chiara & Simpson

[57] ABSTRACT

An air valve for a wet settling machine includes a trapezoidal cross-section valve seat and a valve disk carried on a shaft. The shaft is directly actuated in alternate directions via an electromagnet surrounding the shaft and including a pair of oppositely poled magnetic sections.

19 Claims, 4 Drawing Figures

VALVE FOR A WET JIGGING MACHINE FOR SEPARATING MINERALS

BACKGROUND OF THE INVENTION

1. Field of the Invention

The present invention relates to a wet jigging machine for separating minerals such as coal, etc., in which a pulsation of the working liquid is generated by compressed air which is controlled by disk valves having shaft guidance.

2. Description of the Prior Art

Wet jigging machines for separating minerals and which are controlled by disk valves exhibit servo devices, preferably pneumatic servo devices, for the valve actuation in known embodiments in order to be able to execute the rapid opening and closing movements which are required, despite the size and weight of the disk valves. Given this type of valve actuation, the observance of precise opening and closing times and of identical valve opening characteristics is difficult. On the one hand, fluctuations of air pressure in the compressed air network of the mineral processing plants have an influence, and, on the other hand, for example, so do differences in the humidity or oil content of the compressed air. Therefore, expensive and complicated systems for cleaning the servo air and for maintaining its pressure constant are required.

SUMMARY OF THE INVENTION

The object of the present invention is to provide an actuation device for generally known types of constructions of disk valves which is easy to regulate and which permits a good observance of the prescribed opening and closing times given identical valve actuation characteristics.

The above object is achieved in that disk valves exhibit electromagnetic drives, particularly electromagnets directly influencing the valve shaft. By employing electromagnetic drives for the actuation of the disk valves in a direct manner, all actuation fluctuations are avoided, which would otherwise occur as a result of the changes in the compressed air network of the mineral processing plant. It is particularly advantageous when the electromagnets directly attack the valve shaft, since a particularly simple and rugged design of the drive for operation in an air-free manner can be achieved. Despite the great forces which are necessary in order to achieve the desired high accelerations, the direct attack of an electromagnet, surprisingly, is possible.

It is provided in a development of the invention that the electromagnets are designed as hollow cylinders in which the valve shafts operating as armatures are disposed. By means of this design, a particularly compact, light drive-valve unit is advantageously created which absorbs the forces to be transmitted particularly well, being easy to completely encapsulate, and which is therefore up to the rough operation of a mineral processing plant for coal or ores. The actuation force is transmitted to the valve shaft by way of the shortest conceivable path, without friction losses, for example, in a rod system, so that a particularly good degree of efficiency is obtained and even large jigging machine valves can be electromagnetically actuated.

It is provided in a further development of the invention that the electromagnets have at least two separately controllable windings whose magnetic polarities are preferably directed opposite one another. It is advantageously achieved by such a design that the disk valve cannot only be greatly accelerated but, however, can be decelerated in the same manner. After traversing the structurally predetermined path, therefore, the valve comes to a standstill in the opened or closed state without significant additional braking. Through the interaction of the direct drive with the central arrangement of the valve shaft in the magnet and the separate windings having opposite polarity, a jigging machine valve is provided which is suitable for all control tasks and valve sizes, the valve control being on par in terms of speed and actuation characteristics with known valve controls having servo actuation.

It is provided in a further development of the invention that the electromagnets exhibit control units for the preferably controllable, separate drive of the individual windings. By so doing, justice can be advantageously done to the fact that the opening and closing acceleration differs given the same actuation force, since the dead weight of the valve disk and shaft and the air pressure occurring in the closed position influence the opening and closing accelerations.

It is provided in a further development of the invention that the control units have power thyristors and electrical energy storage elements, particularly banks of capacitors, emitting energy in response to clock pulses. By employing power thyristors and electrical energy stores, it becomes possible with particular advantage to not only achieve a direct drive of the valves but, rather, also to avoid a surge-like mains load which, given the size of the jigging machine valves, would otherwise lead to an unbearable influence of the mains supply of the mineral processing plant.

It is provided in a further development of the invention that the sealing seat or valve seat of the disk valves is designed as a spring element, particularly as a polytetrafluorethylene ring having a trapezoidal cross-section. By employing a spring element as the sealing seat of the disk valve, it is advantageously achieved that the initial acceleration of the disk valve can be increased.

It is analogously provided that a counter spring element influencing the shaft is arranged on the opposite end of the valve structure. This spring element also increases the initial acceleration and reduces the power to be exerted by the electromagnets when, as is advantageously possible, a restraining force is exerted in the end positions by the electromagnets which prestresses the spring element.

It is provided in a further development of the invention that the disk valve have a damper connected to the shaft. By employing a damper, the oscillations otherwise occurring due to the great changes of acceleration which occur are advantageously prevented and a quite operation of the valve is achieved.

It is provided in a further development of the invention that the electromagnets have a cooling, particularly an air cooling. Heating of the electromagnets due to valves that are too great is prevented by cooling. An air cooling is particularly advantageous, particularly when the working air of the machine is employed for the cooling.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
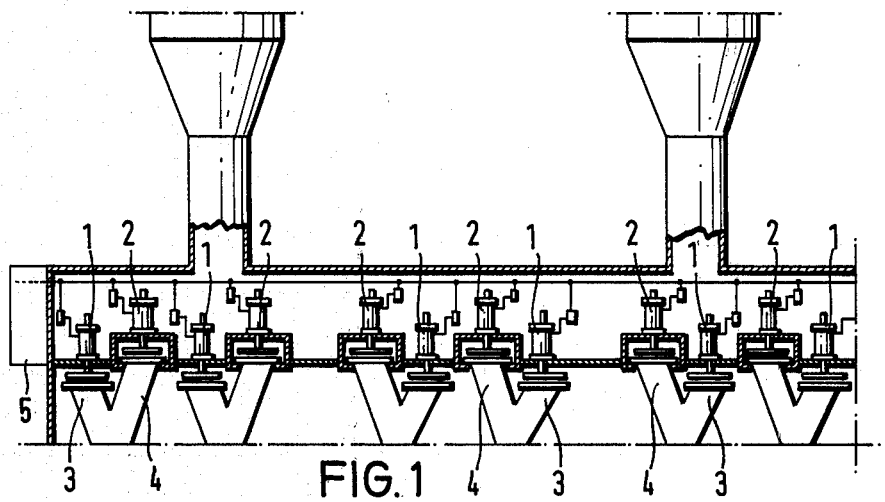
FIG. 1 illustrates the valve portion of a wet jigging machine which may employ electromagnetically actuated valves constructed in accordance with the present invention.

Referring to FIG. 1, the air intake valves and the air exhaust valves, basically identical in construction, are illustrated and referenced as 1 and 2, respectively. The air intake valves 1 and the air exhaust valves 2 are located at the upper ends of the pulsed air feed and discharge lines 3 and 4, respectively. The valves are electrically connected to a control device 5 (connections not shown) and can be disposed either directly at the jigging machine or at a protected location beyond the area of the jigging machine, for example, in a machine booth.

Figure 2:
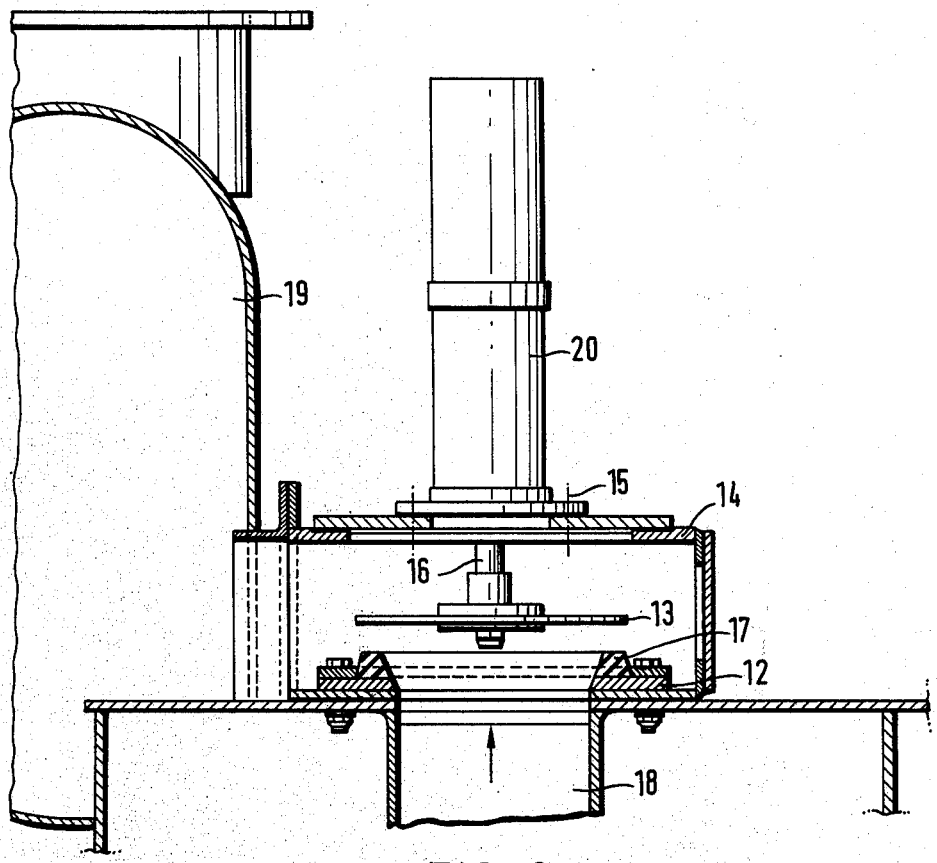
FIG. 2 is a sectional view of a portion of an electromagnet and valve unit constructed in accordance with the present invention.

Referring to FIG. 2, a valve disk 13 is releasably connected to a valve shaft 16. The diameter of such a valve disk amounts to, for example, 300–400 mm and the stroke thereof amounts to 30–40 mm. The adjacent pulsed air has a pressure of 1.4 bar.

The valve shaft 16 is centrally disposed in an electromagnet 20 which is connected to the valve housing 14, as shown for an air exhaust valve, by way of a screw connection 15. A feed line 18 corresponds to the upper portion of the pulsed air line 4 of FIG. 1. An air dome 19 lies behind the valves 1 and 2 having its exhaust lines in FIG. 1 and is also laterally disposed adjacent the valve housing 14. A ring 12 which carries a spring or sealing element 17, preferably consisting of rubber of synthetic material, is disposed as a valve seat at the head of the exhaust line 18.

Figures 3, 4:
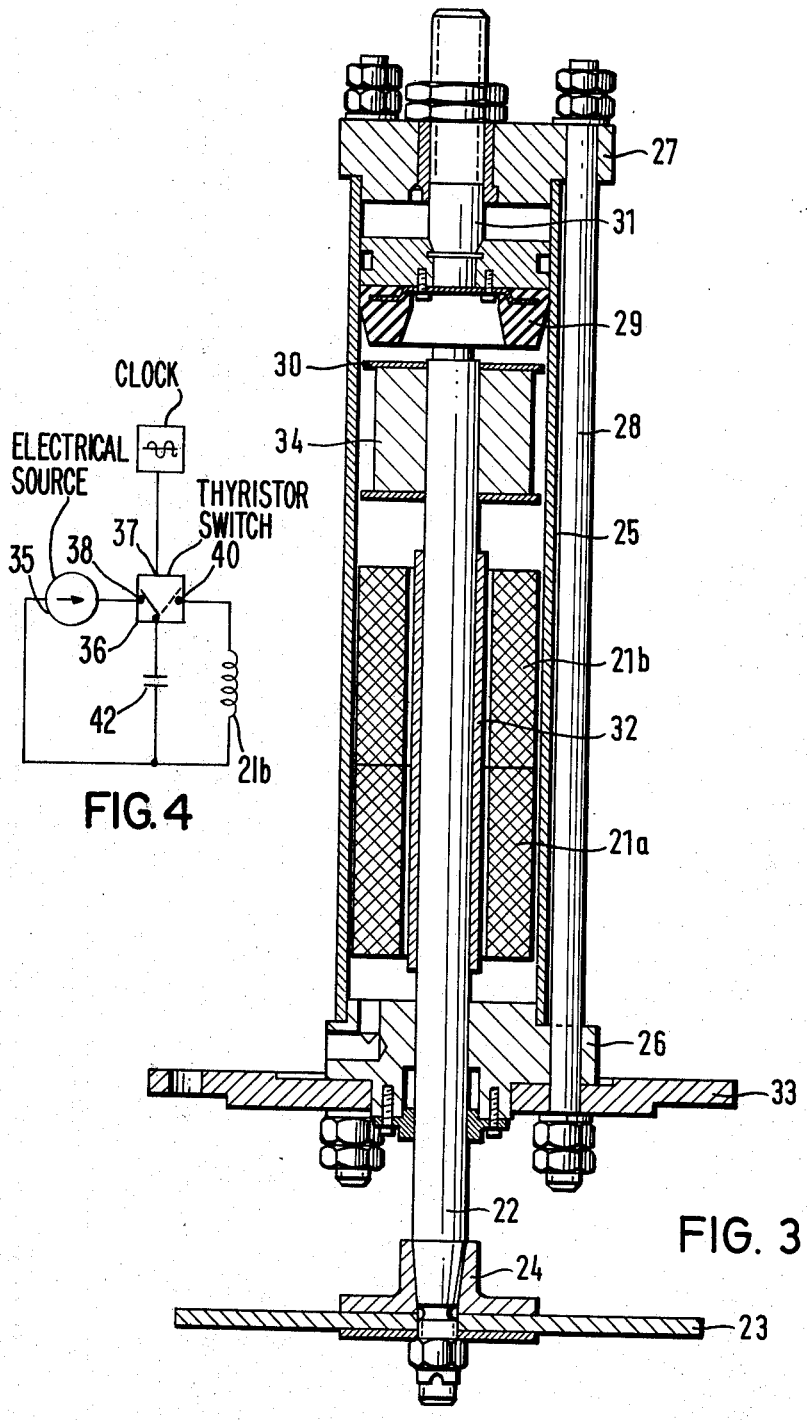
FIG. 3, in an enlarged scale, illustrates, in a cross-sectional view, the electromagnet and valving structure of the present invention.
FIG. 4 illustrates, in schematic circuit diagram form, a control unit, according to the present invention, for actuating a valve constructed in accordance with the present invention.

FIG. 3 illustrates further details of the electromagnet, for example, for an air intake valve. The valve comprises a stator 21 which is divided into two sections 21*a* and 21*b* which include individually controllable and driveable windings which are poled opposite to one another, that is are poled to provide oppositely directed magnetic forces when current is fed therethrough in the same direction. A valve shaft 22, corresponding to the valve shaft 16 of FIG. 2, carries a valve disk 23 at its lower end and is disposed in the stator windings 21*a* and 21*b* which are designed as hollow cylinders. The valve disk 23 is preferably releasably connected to the valve shaft 22 by a cone seat via a hub 24. A housing 25 is disposed over the exterior of the stator 21*a*, 21*b*, with the housing 25 being closed at each end by end caps 26 and 27 which are held together by tie rod bolts 28. Therefore, the housing 25 with the caps 27 and 27 and the tie rod bolts 28 forms a closed unit, within which the portions of the electromagnetic system and the spring and damping elements are protectively arranged.

Whereas the spring elements 17 operating as a valve seat, also, provides an increase of the initial acceleration on the valve seat side, a spring element 29 is provided on the opposite end of the shaft to be struck by an end plate 30 carried by the shaft as the shaft moves to the open state of the valve. The position of the spring element 29 can be adjusted by an adjustable spindle 31 which is threadingly received in a threaded bushing disposed in the end plate 27. A damping element 34 is carried at the rear end of the valve shaft. In order to improve the magnetic properties, the valve shaft 22 carries a magnetic cylindrical bushing 32; surprisingly, the shaft only need be guided in the lower closure plate or end cap 26 of the cylinder housing. The fastening of the electro magnet to the valve housing occurs by way of a plate 33, preferably by means of screws.

A jigging machine constructed in accordance with the present invention, has a valve drive which is particularly suited for jigging machines in which particularly high requirements are made of the valve control. Without leaving the framework of the invention, however, its employment is also possible given all types of jigging machines.

Referring to FIG. 4, one section of a multisection control device 5 is illustrated of controlling the operation of the valve in one direction, for example with respect to the winding 21*b*. In FIG. 4, a current supply or an electrical energy supply 35 is provided which is connected, at non-actuation times, to an energy storage device 42, such as a capacitor or capacitors, by way of a switch 36 located in its switch position 38. This charges the capacitor to store electrical energy.

During actuation, as indicated by the switch 36 being in the position 40, the energy stored in the capacitor 42 is transferred to the winding 21*a* for movement of the shaft 22 in the corresponding direction. Transfer of the switch 36 from the position 38 to the position 40, or from the position 40 to the position 38 is occasioned by the application of controlling pulses to the input 37 of the switch 36. The switch 36 may be constituted by power thyristors to which pulses of one polarity cause connection to the source 35 and pulses of an opposite polarity cause connection to the terminal 40. In one position, therefore, the capacitor 42 becomes charged with electrical energy and in the other position the electrical energy is transferred to the operating winding 21*a*. The clock providing the clock pulses is cyclical in accordance with the desired sequence of operation of the jig.

Although we have described our invention by reference to particular illustrative embodiments thereof, many change and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a wet settling machine for separating mineral mixtures in which a separating liquid is caused to pulsate by the cyclic opening and closing of disk valves driven by electromagnets each of which valves includes a valve disc carried on a valve shaft and an electromagnet, the improvement wherein:

said electromagnet and said shaft are mounted for direct electromagnetic driving of said shaft;

a damping mass carried on said shaft; and resilient means mounted to be struck by said damping mass at a point displaced from said disc as said shaft travels toward said point.

2. The improved valve structure of claim 1, wherein: said electromagnet comprises a hollow cylindrical shape and said shaft is mounted within said electromagnet for axial longitudinal movement.

3. The improved valve structure of claim 2, wherein: each of said electromagnets comprises first and second axially aligned windings poled to produce opposite electromagnetic driving of said shaft.

4. The improved valve structure of claim 3, and further comprising:

for each valve winding, a separate control circuit for energizing the winding.

5. The improved valve structure of claim 4, wherein each of said control circuits comprises:

electrical energy storage means for receiving and storing electrical energy; and clock-operated switch means cyclically connecting the energy storage means to the respective winding.

6. The improved valve structure of claim 5, wherein said energy storage means comprises capacitor means.

7. The improved valve structure of claim 5, wherein said switch means comprises power thyristor means.

8. The improved valve structure of claim 1, and further comprising:

a ring-shaped valve seat for said disk having a trapezoidal cross-section.

9. The improved valve structure of claim 8, wherein: said valve seat comprises tetrafluorethylene.

10. The improved valve structure of claim 1, and further comprising:

a damping mass carried on said shaft.

11. The improved valve structure of claim 1, and further comprising:

passageway means for supporting a flow of cooling air past said electromagnet.

12. An electromagnetic valve for opening and closing a passageway, comprising:

a valve seat surrounding the passageway;

an elongate hollow housing including first and second ends;

a first end cap closing said first end and including an axial bore;

an electromagnet mounted in said housing and including a pair of hollow winding for alternate energization in opposite directions;

an elongate shaft extending axially through said bore and said windings for axial movement responsive to energization of either of said windings;

a valve disk carried on an end of said shaft outside of said housing for engaging and disengaging said valve seat;

a second end cap closing said second end of said housing;

resilient means mounted in said housing adjacent said second end cap; and a damping mass carried on said shaft to engage said resilient means upon movement of said shaft towards said second end of said housing.

13. The valve of claim 12, wherein:

said valve seat comprises a ring-shaped member including a trapezoidal cross-section.

14. The valve of claim 13, wherein:

said ring-shaped member comprises tetrafluorethylene.

15. The valve of claim 12, and further comprising:

means carried on said shaft for increasing the magnetic forces applied to said shaft.

16. The valve of claim 12, wherein:

said resilient means comprises a ring-shaped member including a trapezoidal cross section.

17. The valve of claim 12, and further comprising:

first and second cooperable means on said second end cap and said resilient means mounting said resilient means.

18. The valve of claim 17, wherein:

said first means comprises first threaded means carried by said second end cap; and said second means comprises second threaded means carried by said resilient means adjustably engaging said first threaded means.

19. The valve of claim 17, and further comprising:

passageway means for supporting a flow of cooling air through said housing.

* * * * *